US007931272B2

(12) United States Patent
Möhringer et al.

(10) Patent No.: US 7,931,272 B2
(45) Date of Patent: Apr. 26, 2011

(54) SHEET DELIVERY AND SHEET-PROCESSING PRINTING MACHINE

(75) Inventors: Markus Möhringer, Weinheim (DE); Stefan Mutschall, Östringen (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 122 days.

(21) Appl. No.: 12/388,162

(22) Filed: Feb. 18, 2009

(65) Prior Publication Data

US 2009/0224470 A1 Sep. 10, 2009

(30) Foreign Application Priority Data

Mar. 10, 2008 (DE) ..... 10 2008 013 319

(51) Int. Cl.
*B65H 29/04* (2006.01)

(52) U.S. Cl. ..... 271/204; 271/306; 271/183

(58) Field of Classification Search ..... 271/206, 271/204, 69, 306, 307, 308
See application file for complete search history.

(56) References Cited

U.S. PATENT DOCUMENTS

| | | | | |
|---|---|---|---|---|
| 4,991,832 | A * | 2/1991 | Spiegel et al. | 271/183 |
| 5,011,125 | A * | 4/1991 | Spiegel et al. | 271/183 |
| 5,179,900 | A | 1/1993 | Schwitzky | |
| 7,261,291 | B2 | 8/2007 | Förch et al. | |
| 7,367,558 | B2 * | 5/2008 | Forch et al. | 271/206 |
| 7,578,502 | B2 * | 8/2009 | Forch et al. | 271/191 |
| 7,708,277 | B2 * | 5/2010 | Mohringer et al. | 271/306 |
| 2008/0012217 | A1 * | 1/2008 | Bottger et al. | 271/279 |

FOREIGN PATENT DOCUMENTS

| | | |
|---|---|---|
| DE | 199 19 458 A1 | 3/2000 |
| DE | 103 43 428 A1 | 5/2004 |
| DE | 103 45 703 A1 | 5/2004 |
| DE | 41 19 188 C1 | 9/2006 |

OTHER PUBLICATIONS

German Patent and Trademark Office Search Report, dated Nov. 10, 2008.

* cited by examiner

*Primary Examiner* — Stefanos Karmis
*Assistant Examiner* — Luis Gonzalez
(74) *Attorney, Agent, or Firm* — Laurence A. Greenberg; Werner H. Stemer; Ralph E. Locher

(57) ABSTRACT

A sheet delivery has an endless conveyor for conveying printed sheets and a secondary gripper with a gripper bar for holding printed sheets received at their trailing edges from the endless conveyor, to be deposited on a delivery stack. A transmission generates an annular circulatory movement of the gripper bar. A first balance weight and a second balance weight are provided for compensating for interference torques and are braced for rotation in relation to one another by a spring.

6 Claims, 5 Drawing Sheets

SHEET DELIVERY AND SHEET-PROCESSING PRINTING MACHINE

CROSS-REFERENCE TO RELATED APPLICATION

This application claims the priority, under 35 U.S.C. §119, of German patent application DE 10 2008 013 319.1, filed Mar. 10, 2008; the prior application is herewith incorporated by reference in its entirety.

BACKGROUND OF THE INVENTION

Field of the Invention

The present invention relates to a sheet delivery having an endless conveyor for conveying printed sheets, and also having a secondary gripper with a gripper bar by means of which the printed sheets are received at their trailing edges by the endless conveyor and are deposited on a delivery stack, and having a transmission for generating an annular circulatory movement of the gripper bar.

Sheet deliveries typically comprise endless conveyors in the form of chain conveyors. In the case of some of these sheet deliveries with chain conveyors, the chains carry gripper bars for securing not just the leading edges of the printed sheets which are to be transported, but also the trailing edges of these printed sheets. In the case of those sheet deliveries which secure the respective printed sheet not just at its leading edge but also, at the same time, at its trailing edge, a so-called secondary gripper is required to be present in order to ensure that the printed sheet is deposited precisely on the delivery stack. The secondary gripper comprises a gripper bar which receives the printed sheet from that gripper bar of the chain conveyor which secures the trailing edge of the printed sheet. In order for the gripper bar of the secondary gripper to circulate in the form of an elongate ring, there is a need for a transmission which comprises a partial transmission arranged on the drive side of the machine and a partial transmission arranged on the operating side.

Commonly assigned German published patent application DE 103 43 428 A1 (cf. U.S. Pat. No. 7,261,291 B2) describes a sheet delivery with such a secondary gripper. The two partial transmissions there are arranged in transmission casings outside lateral frameworks and are connected to one another by a common drive shaft. The partial transmissions are designed as coupler transmissions. It is disadvantageous that the transmission comprising the two partial transmissions can give rise to interference torques which adversely affect the function.

Commonly assigned German published patent application DE 103 45 703 A1 likewise describes a sheet delivery with a secondary gripper of which the gripper bar is driven via coupler transmissions. A solution to the problem of the interference torques caused by secondary-gripper transmission is not indicated.

SUMMARY OF THE INVENTION

It is accordingly an object of the invention to provide a sheet delivery, which overcomes the above-mentioned disadvantages of the heretofore-known devices and methods of this general type and which provides for a particularly precisely operating sheet delivery. In particular it is an object of the invention to provide a sheet delivery of the generic type described in the introduction and in the case of which the interference torques are eliminated or at least minimized to a sufficient extent.

With the foregoing and other objects in view there is provided, in accordance with the invention, a sheet delivery, comprising:

an endless conveyor for conveying printed sheets;

a secondary gripper with a gripper bar configured to receive the printed sheets from said endless conveyor at trailing edges thereof and to deposit the printed sheets on a delivery stack;

a transmission for generating an annular circulatory movement of said gripper bar; and a first balance weight and a second balance weight configured to compensate for interference torques, and a spring disposed to brace said first and second balance weights against rotation relative to one another.

In other words, the sheet delivery according to the invention comprising an endless conveyor for conveying printed sheets, and also comprising a secondary conveyor with a gripper bar by means of which the printed sheets are received at their trailing edge by the endless conveyor and are deposited on a delivery stack, and with a transmission for generating an annular circulatory movement of the gripper bar, is characterized in that a first balance weight and a second balance weight are provided for compensating for interference torques and are braced for rotation in relation to one another by a spring.

One advantage of the sheet delivery according to the invention is that the two balance weights, which may be designed as so-called flywheels, compensate for statically caused interference torques. This ensures a high degree of precision of the circulatory movement of the gripper bar and smooth machine operation.

For example, the first balance weight may be connected in a rotationally fixed manner to a hollow shaft into which projects an internal shaft which is connected in a rotationally fixed manner to the second balance weight, the hollow shaft and the internal shaft being braced for rotation in relation to one another by the spring. The spring here may be a helically wound torsion spring, a so-called leg spring, which has one end supported on the hollow shaft and its other end supported on the internal shaft.

In accordance with an added feature of the invention, the spring is a torsion spring. This torsion spring may be connected in a rotationally fixed manner to the first balance weight at one end and to the second balance weight at its other end, in which case it is possible to dispense with the abovementioned hollow shaft and the abovementioned internal shaft, which are connected in a rotationally fixed manner to the balance weights. This reduces the number of components. Moreover, despite its advantageous compactness, the torsion spring is capable of generating sufficiently high spring forces.

In accordance with an additional feature of the invention, a respective crank with attached coupling link—referred to as a double link or a double joint—is articulated on the balance weights, and the two double links each carry a cam roller and the two cam rollers are guided by a respective control cam. The two control cams are preferably radial cams. Via the cam rollers running over them, the control cams cause the double links to oscillate periodically. The expression "double link" may also be described as a "crank with coupling link," a double link reciprocator or a double jointed crank.

In accordance with again another development, the two double links each have an oscillating crank and a coupler. The oscillating cranks are articulated on a respective coupler. The two couplers carry the cam rollers and are fastened on the balance weights via rotary articulations. The balance weights are driven in rotation via the two couplers and the two oscillating cranks. Accordingly, the movement of the respective balance weight about its geometrical axis of rotation is transmitted to the balance weight via the respective rotary articulation, which is arranged eccentrically in relation to the axis of rotation of the balance weight. The rotary articulation here moves together with the respective balance weight about the geometrical axis of rotation thereof.

In accordance with yet a further development, the two control cams are arranged such that they do not rotate. Accordingly, the control cams do not rotate along with the two balance weights. As the balance weights rotate, they move relative to the control cams at a standstill. The fact that the two control cams do not rotate as the sheet delivery is in operation does not mean that the fixed angle-of-rotation position of the control cam which is maintained during operation of the machine cannot be adjusted and corrected during assembly of the sheet delivery or maintenance thereof.

With the above and other objects in view there is also provided, in accordance with the invention, a printing machine which is equipped with the sheet delivery according to the invention as summarized above. The printing machine according to the invention is preferably an offset rotary printing machine.

Other features which are considered as characteristic for the invention are set forth in the appended claims.

Although the invention is illustrated and described herein as embodied in a sheet delivery, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE SEVERAL VIEWS OF THE DRAWING

FIG. 3B shows a sectional view of a section taken along the line IIIb-IIIb in FIG. 3A;

DETAILED DESCRIPTION OF THE INVENTION

Figure 1:
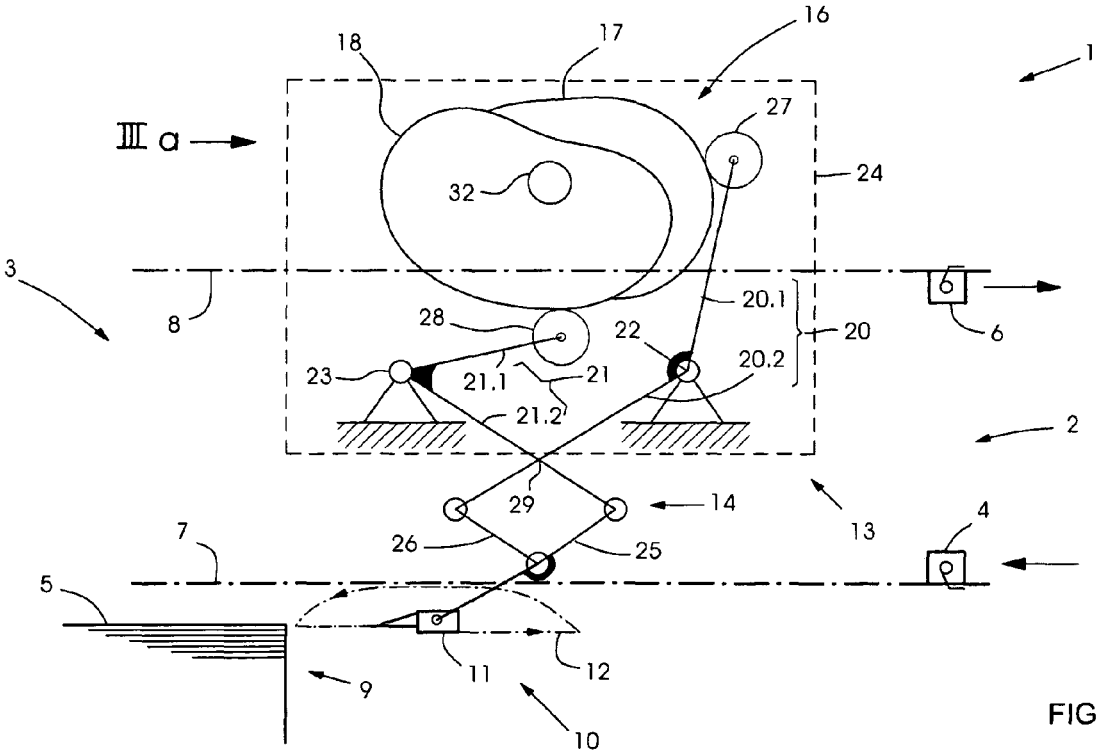
FIG. 1 is a schematic view of a chain conveyor and a secondary gripper.

Referring now to the figures of the drawing in detail and first, particularly, to FIG. 1 thereof, there is shown a detail of a printing machine 1. The printing machine 1 is an offset rotary printing machine. The detail shows a sheet delivery 2 of the printing machine 1. The sheet delivery 2 comprises an endless conveyor 3, which is a chain conveyor. The endless conveyor 3 comprises, on the drive side and the operating side in each case, an endless chain for carrying gripper bars 4 for retaining the leading edges of the printed sheets 5 and an endless chain for carrying gripper bars 6 for retaining the trailing edges of the printed sheets 5. The drawing illustrates a forward strand 7 of that endless chain on one machine side which carries the leading-sheet-edge gripper bars and a return strand 8 of that endless chain on the same machine side which carries the trailing-sheet-edge gripper bars. The forward strands of all four endless chains run horizontally in the direction towards a delivery stack 9, on which the printed sheets 5 are deposited. The four return strands 8 of the endless chains run parallel to the forward strands 7, but in the direction away from the delivery stack 9. The arrows in the drawing indicate symbolically the running directions of the forward strands 7 and of the return strands 8, which are arranged above the forward strands 7.

A secondary gripper 10 receives the trailing edges of the printed sheets 5 from those gripper bars 6 of the endless conveyor 3 which secure these trailing sheet edges as these gripper bars 6 pass through the region of the forward strands 7. The secondary gripper 10 comprises a gripper bar 11 which, like the gripper bars 4 and 6 of the endless conveyor 3, is equipped with a series of grippers by means of which the respective printed sheet 5 is clamped in. For the purposes of gripping the printed sheet 5 and of depositing the printed sheet 5 on the delivery stack 9, the gripper bar 11 of the secondary gripper 10 executes an annular circulatory movement 12, which is indicated by dash-dotted ghost lines in the drawing.

Figure 2:
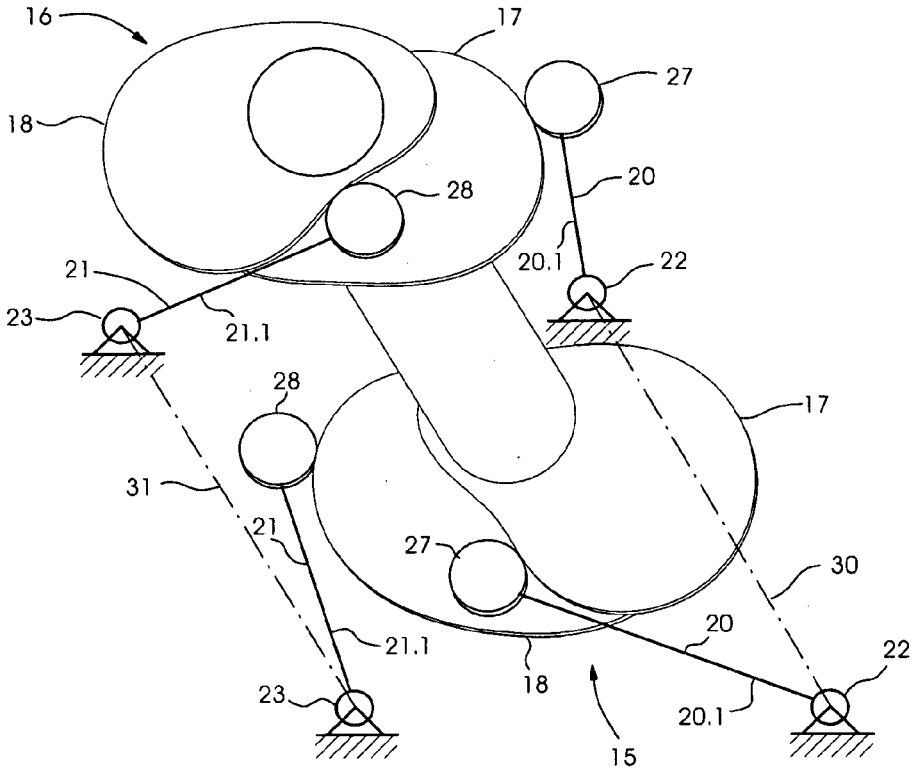
FIG. 2 is a three-dimensional illustration of a cam mechanism for driving the secondary gripper.

A transmission 13 is provided in order to generate this circulatory movement 12. The transmission comprises, as a partial transmission on the drive side and on the operating side, a respective cam mechanism and a coupler transmission 14 which is driven by the respective cam mechanism. The cam mechanism located on the one machine side comprises a first control-cam pair 15 and the cam mechanism located on the other machine side comprises a second control-cam pair 16, as can be seen in FIG. 2. FIG. 1 shows just one of the two control-cam pairs 15, 16 and one of the two coupler transmissions 14. Each control-cam pair 15, 16 comprises a first cam 17, which is located on the inside as seen in the axial direction, and a second, axially outer cam 18. The two first cams 17 and the two second cams 18 are each radial cams, and all four cams 17, 18 have a common geometrical axis of rotation 19 (cf. FIG. 3A).

Since the two coupler transmissions 14 are constructed identically to one another, the following description of the one coupler transmission 14 also applies analogously to the other. The coupler transmission 14 shown comprises a first driving oscillating crank 20 with a first lever arm 20.1 and a second lever arm 20.2, and also comprises a second driving oscillating crank 21 with a first lever arm 21.1 and a second lever arm 21.2. The two driving oscillating cranks 20, 21 are mounted on an auxiliary framework 24, a so-called transmission casing, such that they can be rotated via articulations 22, 23. The second lever arm 21.2 of the second driving oscillating crank 21 is connected, via a further rotary articulation, to an output oscillating crank 25 which, by way of its end opposite to the further rotary articulation, carries the gripper bar 11 of the secondary gripper 10. The second lever arm 20.2 of the first driving oscillating crank 20 is connected, via a rotary articulation, to a coupler 26, which is connected to the output oscillating crank 25 via a further rotary articulation. Accordingly, the second driving oscillating crank 21 and the output oscillating crank 25 together form a first double link and the first driving oscillating crank 20 and the coupler 26 together form a second double link. The latter is articulated on the first double link. The first lever arm 20.1 of the first driving oscillating crank 20 carries a first cam roller 27, which runs over the first cam 17. The first lever arm 21.1 of the second driving oscillating crank 21 carries a second cam roller 28, which runs over the second cam 18.

The articulation 22, about which the first driving oscillating crank 20 can be pivoted, and the articulation 23, about which the second driving oscillating crank 21 can be pivoted, are located above all of the forward strands 7 of the endless conveyor 3. The forwards strands 7 are located substantially on one and the same vertical height level. The two articulations 23 are located beneath all of the return strands 8. The return strands 8 are located substantially on one and the same vertical height level. The second lever arm 20.2 of the first driving oscillating crank 20 and the second lever arm 21.2 of the second driving oscillating crank 21 together form a crossover point 29, as seen in the horizontal direction perpendicular to the plane of FIG. 1. This crossover point 29, like the articulations 22, 23, is located in a region which, as seen vertically, is situated between the forward strand 7 on the one hand, and the return strand 8, on the other hand. As seen in the horizontal direction parallel to the plane in FIG. 1, the crossover point 29 is located between the articulation 22 of the first driving oscillating crank 20 and the articulation 22 of the second driving oscillating crank 21.

Of the two lever arms which have the first oscillating cranks and the second driving oscillating cranks on the operating side and the drive side in each case, FIG. 2 illustrates in each case only the first lever arm 20.1 and 21.1, respectively. By means of a first torsion spring 30, the two first driving oscillating cranks 20, namely the one and the drive side and that on the operating side, are braced in rotation in relation to one another, in which case the force of the first portion spring 30 presses the first cam rollers 27 against the first cams 17. By means of a second torsion spring 31, the two second driving oscillating cranks 21 are braced in rotation in relation to one another, in which case the second cam roller 28 of the second driving oscillating crank 21 which is arranged on the drive side is forced by the second torsion spring 31 against the circumferential surface of the second cam 18 which is arranged on the drive side, and the second cam roller 28 of the second driving oscillating crank 21 which is arranged on the operating side is forced by the second torsion spring 31 against the circumferential contour of the second cam 18 which is arranged on the operating side. The first torsion spring 30 is arranged coaxially with the articulations 22 and the second torsion spring 31 is arranged coaxially with the articulations 23. The first cams 17 are connected in a rotationally fixed manner to the two second cams 18. The first cams 17 are contoured, and the articulations 22 are placed, such that those cam mechanisms on the drive side and the operating side which comprise the first cams 17 realize the same laws of motion. Similarly, the paths of the second cams 18 are configured, and the articulations 23 are arranged, such that the cam mechanism which is located on the drive side of the printing machine 1 and comprises the one second cam 18 realizes the same law of motion as the cam mechanism which is located on the operating side and comprises the other second cam 18.

The first cam rollers 27 butt against points on the circumference of the first cams 17, these points on the circumference being selected such that the two first driving oscillating cranks 20 execute pivoting movements in the same direction. For example, the two first driving oscillating cranks 20, in the first instance, move together in the clockwise direction and, once they have gone beyond the dead-center position or turning points of their pivoting movements, they move together in the counterclockwise direction. It is also the case that the angle-at-circumference points at which the second cam rollers 28 butt against the second cams 18 are selected such that the second driving oscillating cranks 21 together execute pivoting movements in the same direction when the second driving oscillating cranks 21 are driven by the rotating second cams 18. The first cam rollers 27 here butt against flanks of the first cams 17 which are directed away from one another, in which case, when the first driving oscillating cranks 20 move in the clockwise direction, the flank of the one first cam 17 presses onto the first cam roller 27 which butts against this cam flank and, when the first driving oscillating cranks 20 move in the counterclockwise direction, the flank of the other first cam 17 presses onto the first cam roller 27 which butts against that cam flank. Analogously, the second cam rollers 28 butt against flanks of the second cams 18 which are directed away from one another, in which case, when the second driving oscillating cranks 21 move in the clockwise direction, the flank of the one second cam 18 presses onto the second cam roller 28 which butts against the same and, when the second driven oscillating cranks 21 move in the counterclockwise direction, the flank of the other second cam 18 presses onto the second cam roller 28 which butts against the same. The arrangement explained above is advantageous in respect of minimizing the loading and thus the wear to the first and second cam rollers 27, 28.

Figure 3A:
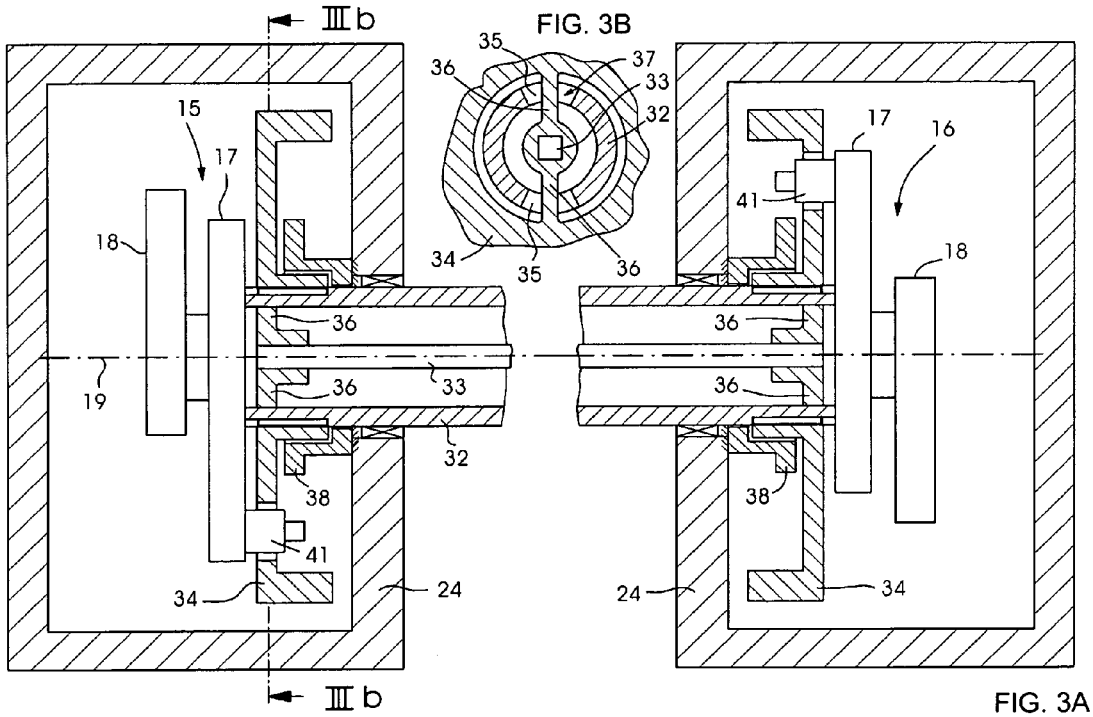
FIG. 3A shows the cam mechanism in an illustration corresponding to the viewing direction IIIa in FIG. 1.

FIG. 3A shows that the first and second cams 17, 18 are fitted in a rotationally fixed manner on a hollow shaft 32. The hollow shaft 32 is driven in rotation by an electric motor via a chain wheel which is seated on the shaft, that is not illustrated in the drawing. The motor drives a drive chain, which is not illustrated in the drawing either and in which the chain wheel engages. The motor may be the main drive of the printing machine 1. The hollow shaft 32 is a so-called synchronizing shaft by means of which that part of the transmission 13 which is arranged on the drive side and the partial transmission which is arranged on the operating side are connected and synchronized.

It is advantageous in production terms to have the hollow shaft 32 arranged above the return strands 8 of the endless conveyor 3. This makes it possible, first of all, to assemble the endless conveyor 3 including its endless chains and, at the same time, to preassemble, as a further structural unit, the secondary gripper 10 including its transmission 13 and, thereafter, to fit the secondary gripper 10 on the endless conveyor 3. This positioning of the one structural unit on the other is similar to the so-called "marriage" in automotive engineering where the preassembled bodywork is positioned on the drive and chassis unit.

Within the hollow shaft 32, a spring in the form of a torsion spring 33 extends from the drive side to the operating side. A balance weight 34 for torque-compensating purposes is fitted in a rotationally fixed manner in each case at the two ends of this torsion spring 33. The two balance weights 34 are braced for rotation in relation to one another by the torsion spring 33. The hollow shaft 32 has, at each end, two diametrically arranged slots 35 which open out in the end periphery of the hollow shaft 32. As can best be seen in the sectional illustration in FIG. 3B, these slots 35 have radial carrying arms 36 of the respective balance weight 34 engaging through them, and provided between the respective carrying arm 36 and slot 35 in the circumferential direction is an amount of play 37 sufficient to allow the balance weight 34 to move back and forth in the circumferential direction relative to the hollow shaft 32.

The balance weights 34 are disks that are arranged coaxially with the first cams 17, the second cams 18 and third cams 38.

In contrast to the first and second cams 17, 18, which are disposed such that they can be rotated relative to the exterior frameworks 24, the one third cam 38 is connected in a rotationally fixed manner to the auxiliary framework 24 and the drive side and the other third cam 38 is connected in a rotationally fixed manner to the auxiliary framework 24 on the operating side. The third cams 38 are likewise radial cams.

The balance weights 34 are arranged between an inner side wall of the respective auxiliary framework 24 and the respective control-cam pairs 15, 16. Each balance weight 34 is arranged between the respective third cam 38 and the respective first and second cams 17, 18, the third cams 38 being placed on those sides of the balance weights 34 which are located closer to the machine interior.

Figure 4:
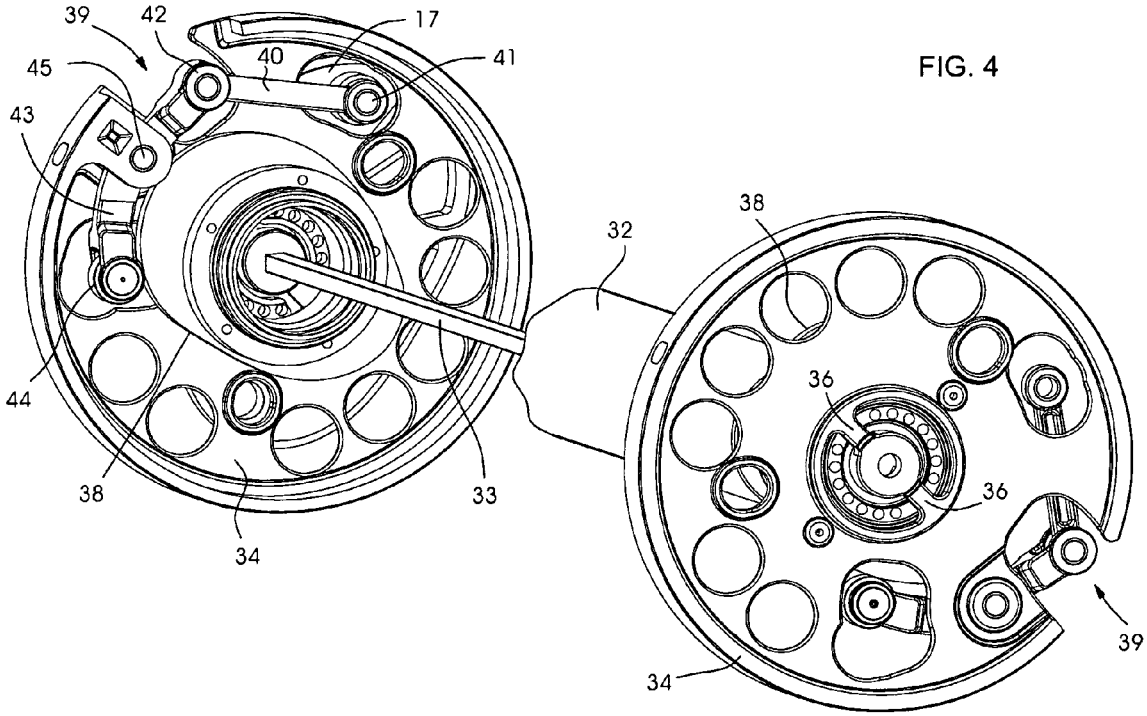
FIG. 4 is a perspective view of balance weights which form constituent parts of an overall transmission of the secondary gripper.

To give a better overview, FIG. 4 does not illustrate the first cam 17 and second cam 18, which are actually present on the side of the machine which forms the front. Each balance weight 34 is driven in rotation via a double link 39. The two double links 39 are arranged diametrically in relation to one another.

On account of the two double links 39 being of identical construction, the following description of the one double link also apply analogous to the other. The double link 39 comprises a coupler 40, which is fitted on the first cam via a first rotary articulation 41. The coupler 41 has its end which is opposite to the first rotary articulation 41 connected to an operating crank 43 via a second rotary articulation 42. At its end which is opposite to the second rotary articulation 42, the oscillating crank 43 carries a cam roller 44, which runs over the third cam 38. Between the cam roller 44 and the secondary rotary articulation 42, the oscillating crank 43 is connected to the balance weight 44 via a third rotary articulation 45. During operation, the torque is transmitted from the first cams 17, via the first rotary articulations 41, to the double links 39 and from these, via the second rotary articulations 42, to the balance weights. The cam rollers 44 here run over the third cams 38, which do not rotate and thus cause the oscillating crank 43 to pivot about the third rotary articulations 45. This pivoting movement causes the respective double link 39 to straighten out, in which case it transmits a circumferentially directed force component, via the third rotary articulation 45, to the respective balance weight 34. The torque generated by this force component coincides with the torque which is transmitted from the hollow shaft 32, via the first cam 17 and the first rotary articulation 41, to the balance weight 34.

The contour of the third cams 38 is designed such that the double link 39, as it circulates about the respective third cam 38, alternately straightens out and is folded closer together again. Accordingly, there is a change in the algebraic sign of said torque, which is generated by the third cam 38 and coincides with the torque which is transmitted from the hollow shaft 32 to the balance weight 34. In other words, as a result of the cam-generated pivoting movement of the double links 39, the balance weights 34 are periodically circumferentially pushed in the direction of the first rotary articulations 41 and pulled away from the same.

This compensates for torque fluctuations which are caused by the mass inertia of the transmission 13 and of the gripper bar 11 during acceleration and deceleration of the same. These torque fluctuations are also referred to as dynamic interference torques and are dependent on speed.

The balance weights 34 serve for compensating for torque fluctuations which are caused by the weight of the gripper bar 11 as it circulates along the circulatory path 12—cf. FIG. 1—in other words the so-called static interference torques. These static interference torques do not depend on speed. As the gripper bar 11 circulates along the circulatory path 12, the gripper bar 11 is first of all raised by the transmission 13 counter to the action of the weight of the gripper bar 11 and is then lowered again, by the transmission 13, under the weight of the gripper bar. The displacement which is necessary here gives rise to the static interference torques, although these are compensated for by the countermeasures explained above. Via the balance weight 34, the torsion spring 33 braces the double links 39, which are articulated on the balance weights, for rotation in relation to one another such that the spring force of the torsion spring 33 presses the cam rollers 44 against the third cams 38.

Figure 5B:
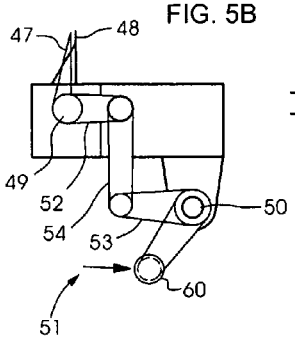
FIG. 5B shows an illustration corresponding to the viewing direction Vb in FIG. 5A.
Figure 5A:
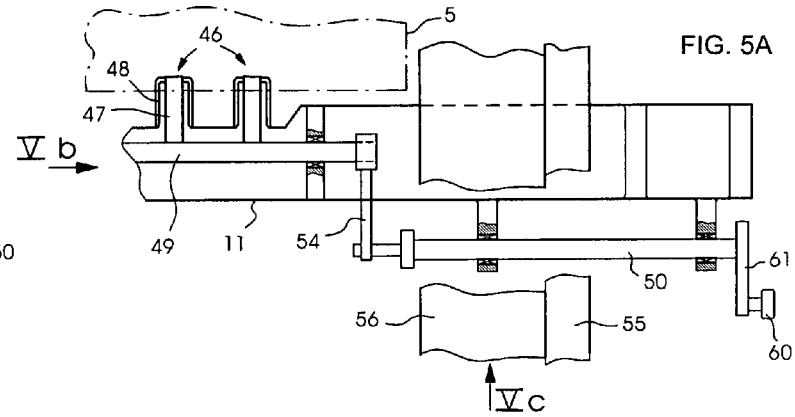
FIG. 5A is a plan view of a gripper bar of the secondary gripper.
Figure 5C:
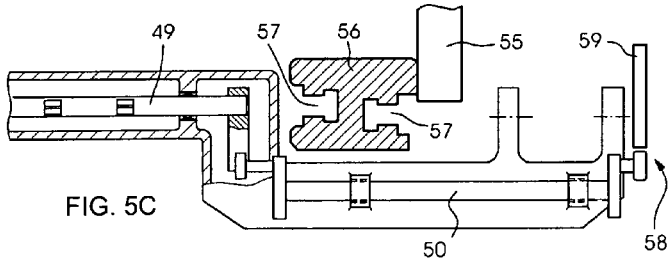
FIG. 5C shows an illustration corresponding to the viewing direction Vc in FIG. 5A.

FIGS. 5A to 5C show the gripper bar 11 of the secondary gripper 10 in detail. The gripper bar 11 comprises a series of grippers 46 which each have a gripping finger 47 and a gripper support 48. The printed sheet 5 is clamped in between the respective gripping finger 47 and the associated gripper support 48. The gripping fingers 47 are seated on a gripper shaft 49, the rotation of which causes the gripping fingers 47 to pivot relative to the gripper supports 48. An intermediate shaft 50 is arranged parallel to the gripper shaft 49 and is connected thereto via a transmission 51. The transmission 51 is a coupler transmission, specifically a four-bar mechanism, and comprises a first oscillating crank 52, which is connected in a rotationally fixed manner to the intermediate shaft 50, a second oscillating crank 53, which is connected in a rotationally fixed manner to the gripper shaft 49, and a coupler 54, which is articulated on the two oscillating cranks 52, 53.

A rail-like chain guide 56, for guiding the endless chains of the endless conveyors 3, is fitted on the inside of a side wall 55 of the sheet delivery 2. The chain guide 56 has two grooves 57, in which run rollers which are fitted on the endless chains, but are not illustrated in the drawing. The two endless chains which are arranged on the one side of the machine are guided by the chain guides 56 in the region of the forward strands 7 of these chains. A further chain guide is arranged on the other side of the machine and guides the other two endless chains in the region of their forward strands.

FIG. 5C shows that the gripper bar 11 is angled, in order to engage in a substantially U-shaped manner around the chain guide 56 and the bottom periphery of the side wall 55. The gripper shaft 49 is located above the bottom periphery of the chain guide 56, and the intermediate shaft 50 extends beneath the chain guide 56 and the side wall 55, past the same, as far as a cam mechanism 58 which is arranged outside the machine framework.

The cam mechanism 58 is located on that side of the chain guide 56 which is directed away from the machine interior, and it comprises a control cam 59, which is fitted in a stationary manner on the machine framework, and a cam roller 60 on a roller lever 61. The roller lever 61 is connected in a rotationally fixed manner to the intermediate shaft 50 and moves the intermediate shaft 50. As the gripper bar 11, together with the roller lever 61, runs past the control cam 59, the cam roller 60 comes into contact with the control cam 59, in which case the gripping fingers 47 are actuated via the intermediate shaft 50, the transmission 51 and the gripper shaft 49. In FIG. 5*b*, an arrow indicates symbolically the force 62 to which the roller lever 61 is subjected by the control cam 59.

The control cam 59 is a so-called gripper-closing cam which pivots the gripping fingers 47 in the direction of the gripper supports 48 counter to the force of a non-illustrated restoring spring in order to close the grippers 46 and to clamp the printed sheet 5 between the elements 47 and 48. The grippers 46 are opened by the force of the restoring spring in a position of the gripper bar 11 relative to the control cam 59 in which the control cam 59 allows the restoring spring, which is arranged on the gripper bar 11, to be relieved of stress.

The invention claimed is:

1. A sheet delivery, comprising:

an endless conveyor for conveying printed sheets;

a gripper with a gripper bar configured to receive the printed sheets from said endless conveyor at trailing edges thereof and to deposit the printed sheets on a delivery stack;

a transmission for generating an annular circulatory movement of said gripper bar; and said transmission including a first balance weight and a second balance weight configured to compensate for interference torques, and a spring disposed to brace said first and second balance weights against rotation relative to one another.

2. The sheet delivery according to claim 1, wherein said spring is a torsion spring.

3. The sheet delivery according to claim 1, which comprises a crank with attached coupling link articulated on each said balance weight, each said double link carrying a respective one of two cam rollers, and said two cam rollers are guided by respective control cams.

4. The sheet delivery according to claim 3, wherein said two double links each have a coupler and an oscillating crank articulated on the respective said coupler, wherein said couplers are fastened on said balance weights via rotary articulations and carry said cam rollers, and wherein said balance weights are driven in rotation via said two oscillating cranks and said two couplers.

5. The sheet delivery according to claim 3, wherein said two control cams are disposed such that they do not rotate.

6. A printing machine comprising a sheet delivery, wherein the sheet delivery comprises:

an endless conveyor for conveying printed sheets;

a gripper with a gripper bar configured to receive the printed sheets from said endless conveyor at trailing edges thereof and to deposit the printed sheets on a delivery stack;

a transmission for generating an annular circulatory movement of said gripper bar; and said transmission including a first balance weight and a second balance weight configured to compensate for interference torques, and a spring disposed to brace said first and second balance weights against rotation relative to one another.

* * * * *